US006894650B2

(12) United States Patent
Darden et al.

(10) Patent No.: US 6,894,650 B2
(45) Date of Patent: May 17, 2005

(54) MODULAR BI-POLARIZED ANTENNA

(75) Inventors: William H. Darden, Naperville, IL (US); Marko Spiegel, Lafox, IL (US); Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/480,748

(22) PCT Filed: Jun. 26, 2002

(86) PCT No.: PCT/US02/20122

§ 371 (c)(1),
(2), (4) Date: Dec. 12, 2003

(87) PCT Pub. No.: WO03/017425

PCT Pub. Date: Feb. 27, 2003

(65) Prior Publication Data

US 2004/0183731 A1 Sep. 23, 2004

Related U.S. Application Data

(60) Provisional application No. 60/311,807, filed on Aug. 13, 2001.

(51) Int. Cl.[7] ..... H01Q 1/24

(52) U.S. Cl. ..... 343/702; 343/872

(58) Field of Search ..... 343/702, 700 MS, 343/872, 873, 846

(56) References Cited

U.S. PATENT DOCUMENTS 6,342,860 B1 * 1/2002 Haussler et al. ..... 343/702
6,483,463 B2 * 11/2002 Kadambi et al. .... 343/700 MS
6,624,789 B1 * 9/2003 Kangasvieri et al. ..... 343/702
6,768,460 B2 * 7/2004 Hoashi et al. ..... 343/700 MS

* cited by examiner

*Primary Examiner*—Hoang V. Nguyen
(74) *Attorney, Agent, or Firm*—Thomas D. Paulius

(57) ABSTRACT

An antenna system utilizing a pair of antenna modules each having an antenna and a dielectric frame embracing the antenna. A complementary interengaging structure is provided between the frames of the pair of antenna modules to hold the modules together and to maintain the respective pair of antennas in a predetermined relative orientation. The attachment structure is on exterior walls of the frames, whereby the walls and attachment structure provide a dual function of an isolation barrier between the antennas.

13 Claims, 4 Drawing Sheets

MODULAR BI-POLARIZED ANTENNA

This application claims the benefit of Provisional Application Ser. No. 60/311,807, filed Aug. 13, 2001.

BACKGROUND OF THE INVENTION

The present invention relates generally to antennas for use with wireless communication apparatus and, more particularly, to a modular antenna system for use with such wireless apparatus in which the antennas of each module are polarized in different directions.

The computer industry is trending toward the use of wireless technology for use in personal computers, laptop computers, personal digital assistants ("PDA's") home control centers, computer work stations, printers, facsimile machines, etc. Previously, all these devices involved the use of special cables to connect these various devices together with device-specific software that often used proprietary protocols. In order to effectively communicate with all of these personal electronic devices, a person might need to obtain many different cables for interconnecting the devices together. However, the person had no assurance that all the devices could interconnect.

In 1998, a special interest group known as "Bluetooth" was developed by Intel, IBM, Nokia, Ericsson and Toshiba in order to create a global specification for short range wireless radio frequency ("RF") communications. This specification was published in 1999 and will be instrumental in the future in achieving interoperability among all kinds of devices, regardless of manufacturer. Hence, Bluetooth is directed toward a technology for the short-range exchange of data. It can be used, for example, to synchronize information between different devices, or to connect Internet linked devices to the Internet without cables. Key to the effective use of Bluetooth technology is a Bluetooth radio module. These modules rely on antennas for effective short range wireless transmittal and receipt of RF signals. Another wireless technology that is being implemented with increasing frequency is the IEEE 802.11 standard that is used to replace wired LANs (Local Area Networks) throughout buildings to thereby permit operation of electronic devices without connecting them to a hard-wired network.

Conventional RF antennas may be used in these applications, but they need to have their structure designed to operate in the high frequency bands (2.4 Ghz) used for Bluetooth and 802.11 communications. Additionally, conventional antennas such as those used on cellular telephones are relatively large and project from the appliance on which they are used, which is undesirable. As a result, the industry has turned to low profile antennas to use in these wireless applications, which include PIFA-style ("planar inverted-F antennas") antennas.

A typical PIFA antenna includes a planar radiating plate located over a ground plate, which are joined together by a short circuit plate. Such PIFA antennas have low profiles, high efficiency and omni-directional radiation patterns which are particularly suitable for wireless communication applications as described above. However, even the use of these PIFA antennas may create its own set of problems. If the antenna is not positioned correctly in the electronic component, the antenna may be placed in what is known as a "dead spot" where transmitted signals combine with reflected signals that cancel the desired transmitted signal, which condition is also known as a deep fade where transmitted signal levels drop below a detectable level.

A room or other closed environment may have many dead spots, depending on its configuration, and the placement of the wireless device in the environment. It is burdensome on the user to think of the presence of dead spots and locate wireless equipment accordingly. One way to eliminate such dead spots is to utilize multiple antennas that increase signal strength due to spatial diversity or array methods. However, this solution has its own problems in that often the individual radiating elements mutually couple together.

The present invention is directed to a solution to this "dead spot" problem and is directed to an antenna that overcomes the aforementioned disadvantages.

SUMMARY OF THE INVENTION

A general object, therefore of the present invention is to provide an improved modular antenna system employing a plurality of individual antennas with polarization diversity in order to overcome instances where the polarization of the device is unknown or where it become depolarized in the environment.

Another object of the present invention is to provide an improved wireless antenna having a low profile and size that may be easily used in PC's, PDA's, laptop computers and the like of which substantially eliminates the problem of deep fades in the use of the device utilizing the antenna of the invention.

A further object of the present invention is to provide a wireless antenna assembly for use with "Bluetooth," or 802.11 technology, in which the antenna assembly includes two PIFA style antennas that are polarized differently so as to substantially eliminate the likelihood of dead spots, or deep fades, in the operational environment of an electronic device.

A still further object of the present invention is to provide a pair of antenna assemblies, each assembly including a PIFA style interior housing in a dielectric housing, the housing being interengageable with each other so as to orient each of the antennas in a different direction, so that dual polarization of the overall antenna assembly is achieved.

These and other objects are attained by way of the novel and unique structure of the invention. In one principal aspect of the present invention, a PIFA-style antenna is formed by bending a conductive plate into a general U-shape wherein the two legs of the U-shape respectively serve as the radiating element and ground plane of the antenna which are interconnected, or short-circuited, by the base of the U-shape. Two of these antennas are provided in the assembly and each is housed in its own dielectric housing, and the housings are interconnected in a manner so that each antenna is polarized differently.

In another principal aspect of the present invention, the two antenna housings having engagement means integrally formed therewith. In the preferred embodiment, this engagement means takes the form of a dovetail member and slot which are formed in offset sides of the two housings so that, when assembled together, the two antennas are oriented in two different directions. The housings further isolate the two antennas from each other and serve to contain the approval plane of each antenna and thereby isolate the antennas from each other.

In yet another principal aspect of the present invention, each antenna includes a T-shaped radiating element and both the radiating element and ground plane are slotted. These two slots are generally aligned with each other and provide a connectorless junction area at which the shielding braid and center conductor of a coaxial feed line may be attached to the antenna by soldering, burning, welding or the like.

In the invention, an antenna assembly is provided in which two antenna housings are engaged together. Each housing is formed from a dielectric material and includes a PIFA-style antenna. Each antenna include a planar, T-shaped radiating element that is aligned with and overlies a planar ground plate that is arranged generally parallel to the radiating element. The two plates are connected by a short circuit plate having a width that is less than the corresponding widths of the radiating element and ground plate. A feed to the antenna is provided in the form of a coaxial cable and the grounding braid of which is terminated to the ground plate while the center conductor is terminated to the radiating element. The antenna assembly has each antenna component oriented differently so that each such antenna is polarized differently. The two components are joined together to minimize the dimensions of the antenna assembly.

Other objects, features and advantages of the invention will be apparent from the following detailed description taken in connection with the accompanying drawings.

BRIEF DESCRIPTION OF THE DRAWINGS

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
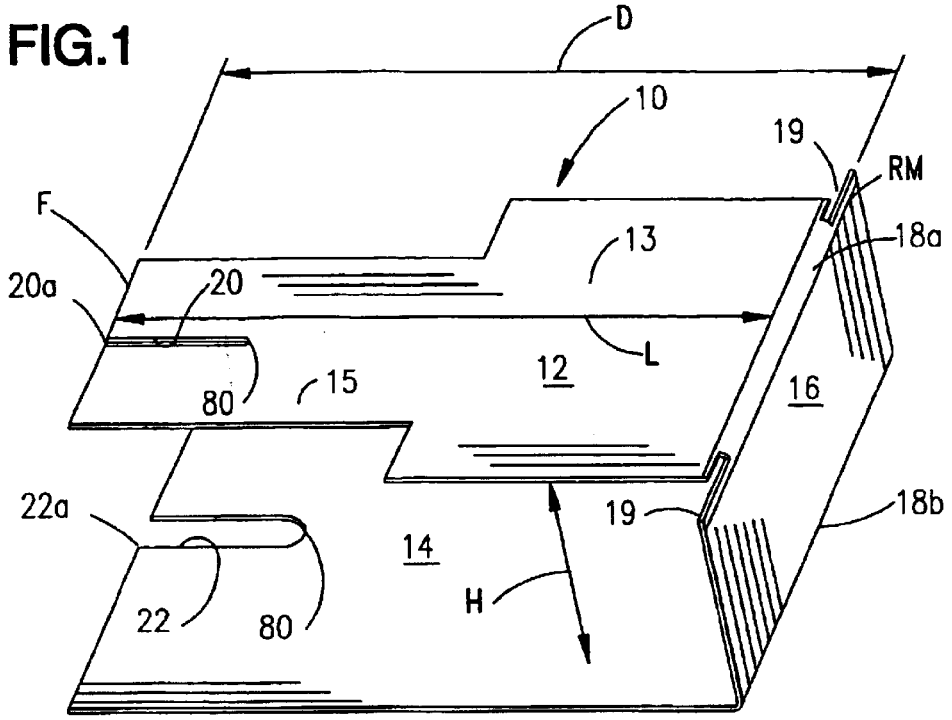
FIG. 1 is a perspective view of an inverted-F antenna (PIFA) that is used in the antenna assemblies of the present invention.

FIG. 1 shows a planar inverted-F antenna element, or "PIFA", 10, which is utilized in the present invention. This antenna element 10 includes a planar first conductive plate 12 with preselected length and widths L1, W2 and a second conductive plate 14 that are interconnected together and spaced apart from each other by a third conductive plate 16 that provides a short circuit between the two plates 12, 14. As shown best in FIG. 1, the radiating plate 12 has a T-shaped configuration with the wider, top portion 13 of the "Tee" being wider and oriented transversely, or offset, from the leg portion 15 of the "Tee".

The second plate 14 has predetermined length and width dimensions L2, W2 that define a preselected surface area of the plate. In the embodiment shown, the second plate 14 has a greater surface area than the first plate 12, and the two plates 12, 14 are preferrable arranged generally parallel to each as is typical to PIFAs. In the embodiment illustrated, the second plate 14 is generally longer than the first plate and the interconnecting third plate generally has a width less than the widths $W_1$, $W_2$ of the first and second plates 12, 14. It will be understood that this parallel arrangement is only preferred and that the two plates, at a minimum maybe disposed in two different planes. The second plate 14 is further connected to the short circuit plate 16 by folding stamping and forming the entire antenna from a single sheet of conductive material and folding it along edges, or folding 18*a*, 18*b* which may be partially alotted as at 19 to facilitate the bending of these plates.

Each inverted-F antenna 10 of the antenna system of the invention is substantially identical to each other. The radiating plate 12 of each antenna 10 is preferably provided with a slot 20 which opens along a front edge 20*a* of the radiating plate 12 at a location opposite the short circuit plate 16, or what will be described herein as the "front end" of the antenna element 10. This slot 20 extends lengthwise within the leg portion 15 of the radiating element, and preferably down the center thereof. The ground plate 14 has a similar slot 22, which is larger than slot 20, that begins at a corresponding edge 22*a* of the plate 14 and also extends lengthwise inwardly of the ground plate 14. The slots are generally aligned with each other vertically and facilitate the terminating of a coaxial feed line 56 to the antenna elements 10 as described hereinafter. Although the modular antenna system of the invention is described herein with the antenna modules of the system incorporating PIFA-style antennas 10, it should be understood that the system of the invention may be applicable for use with other types of antennas.

Figure 2:
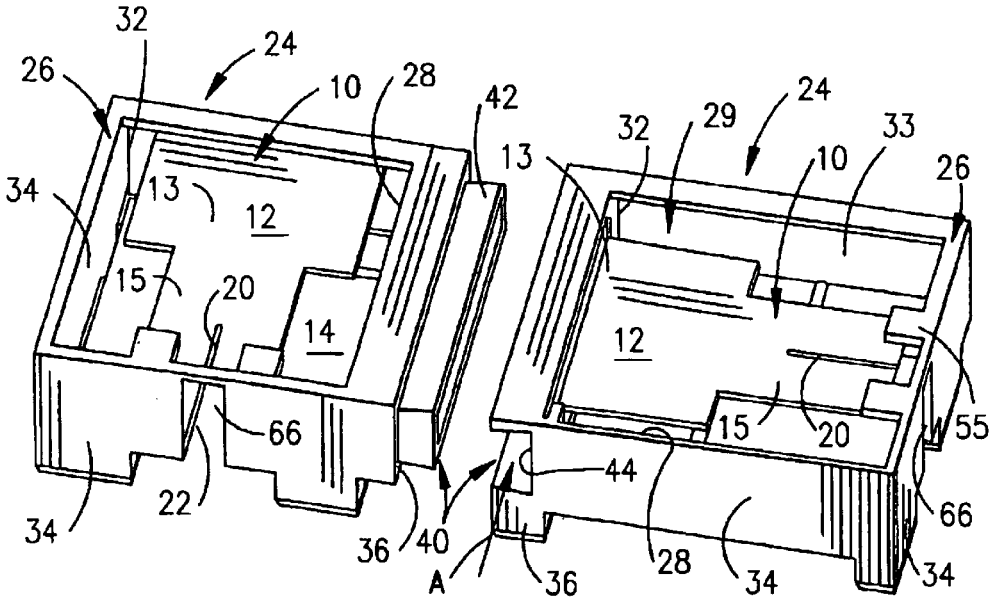
FIG. 2 is a perspective view of a pair of antenna in a position read for connection to each other.
Figure 3:
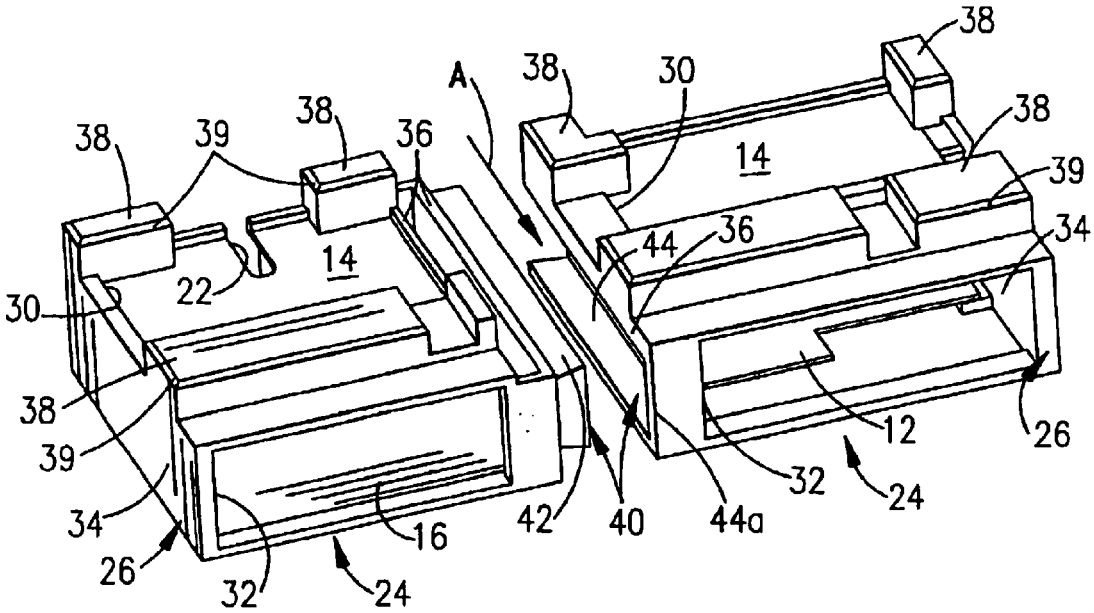
FIG. 3 is a perspective view of the antenna modules of FIG. 2, but taken from the underside.

FIGS. 2 and 3 illustrate an antenna "system", or assembly, of the invention that joins together two individual antenna modules 24, which are interengageble as described below. Each antenna module 24 includes a dielectric housing or frame 26, that supports a single antenna 10 element therein. The dielectric housing 26 may be provided as a one-piece structure that is molded of a suitable dielectric material, such as plastic or the like.

As illustrated, each antenna module 24 has a square or rectangular configuration that is slightly larger than the antenna elements 10, so as to easily accommodate the antenna elements therein. In this regard, each module 24 may be considered as having a housing or frame-like structure as is shown in the drawings that utilizes various sidewalls 32, 34, 36 that cooperatively define a housing with a central or interior cavity for the antenna element 10. The housing has two side walls 34 that are disposed adjacent to each other, and a third side wall 36 that includes an engagement means for attaching and joining two corresponding antenna modules together. Interconnecting these three sidewalls 34, 36 is a wall 32 having an opening 33 through which the antenna elements 10 may be inserted into the central cavities 29 of the modules 24.

Each housing 26 has an open top 28 (FIG. 2) and a closed bottom 30 (FIG. 3) and further may include a plurality of mounting pads, or blocks, 38 molded integrally therewith, that are used to facilitate mounting the modules to or within an appropriate structure, such as a laptop computer or desktop computer. The bottom surfaces or mounting blocks 38 may have adhesive layers 39 applied thereto for securing the modules to the structure.

Figure 4:
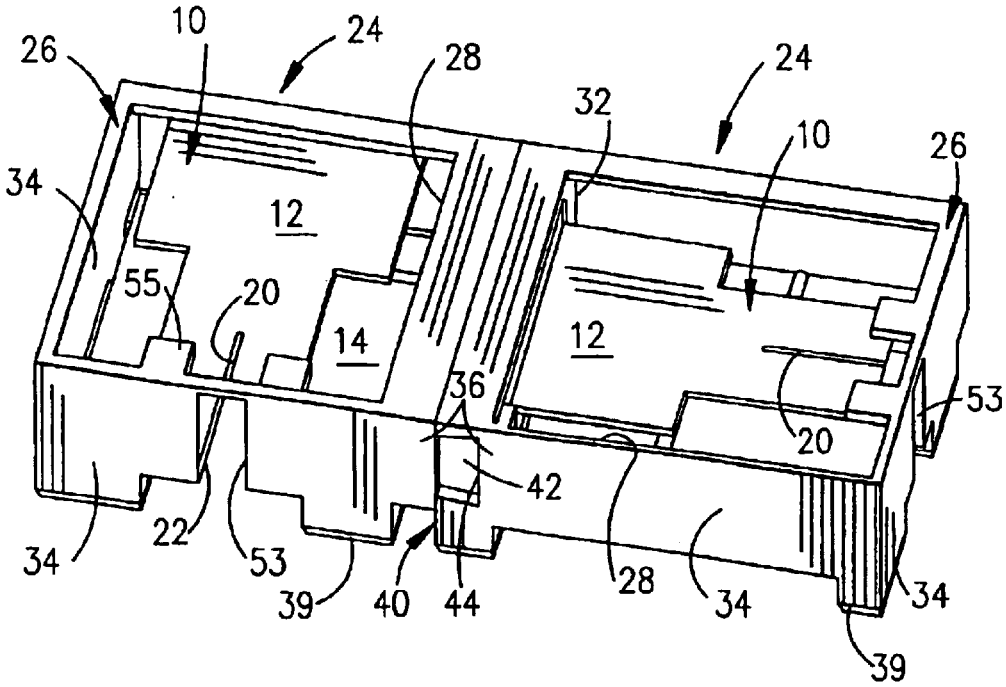
FIG. 4 is a perspective view illustrating the antenna modules joined together.

As mentioned above, the two antenna modules 24 are preferably provided with a means for engaging or interlocking with each other. As best shown in FIGS. 3 and 4, this engagement means 40 may include a dovetail-type engagement means, such as a mortise, or channel, 44 into which a tenon, tongue, or other similar projection 42 fits. This configuration of these two modules is preferably of the mortise-tenon configuration so that the two antenna modules 24 may be interengaged together and reliably retained together once assembled, but other types of engagement are also contemplated such as plugs and receptacles, and any other similar post and recess arrangement. The engagement means assists in orienting the antenna modules 24 in a preferred orientation at approximate right angles to each other, with respect to the polarization of each antenna element 10.

Figure 5:
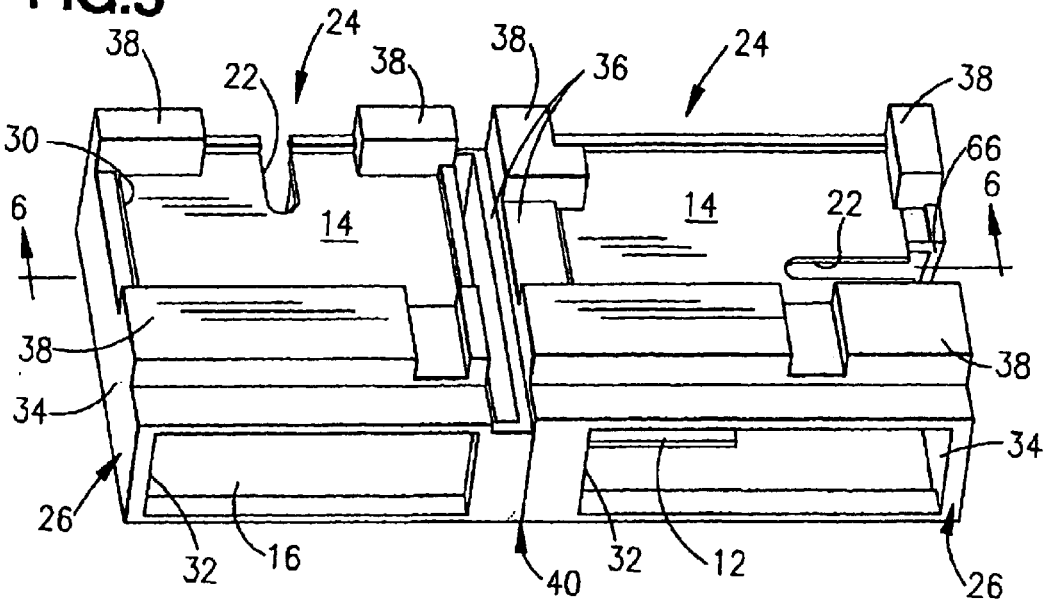
FIG. 5 is a view similar to that of FIG. 3, with the modules interengaged.

The attachment means 40 may take the general form of a tongue-and-groove or mortise and tenon interengaging structure between the exterior portions of the frame attachment walls 36. As seen in FIGS. 2 and 3, an elongated tongue 42 projects from attachment wall 36 of the left-hand module and groove 44 is formed in the corresponding opposing attachment wall 36 of the right-hand antenna module 24. The groove is sized and shaped for receiving the tongue 42. The dovetail tongue 42 is slid into groove 44 in the direction of arrows "A" to join the two antenna modules 24 together as shown in FIGS. 4 and 5. In the preferred embodiment, the tongue 42 and groove 44 have interengaging dovetail configurations in cross-section so that when the modules are interengaged, the modules cannot be pulled apart in a direction transversely of the tongue-and-groove interengaging structure. As shown in FIG. 2, one end of dovetail groove 44 is open and the opposite end 44*a* of the groove is closed.

As illustrated in FIGS. 2 and 4, the top and leg portions 13, 15 of the tee, are oriented in an offset manner with respect to each other. The radiation pattern of each of these antennas may be considered as being at least partially centered around the slots 20 of each antenna and this combined field pattern is shown diagrammatically in FIG. 8. The orientation of each of the T-shaped radiating elements and the feed slots serve to influence the polarization of the radiating elements of each antenna. The direction of polarization occurs lengthwise along the leg portion 15 of each radiating plate 12, i.e., from the slot 20 to the top portion 13 of the T-shape. The length D controls the operational frequencies of the antenna elements, while the width, W, controls the isolation of the antenna elements. The greater the length D, the lower the frequency and the lesser the width W, the more the isolation will approach a minimum. In the preferred embodiment shown, the length D is greater than the width W. As such, the radiating patterns will intersect and provide an overall expanded radiation pattern that is larger than that pattern obtained with a single antenna. This is supplemented by the different widths of the top and leg portions 13, 15 of each antenna, which cooperatively produce a band width that is greater than of a single, or constant, width section. This T-shape of the antenna elements approximate a bowtie antenna.

Figure 6:
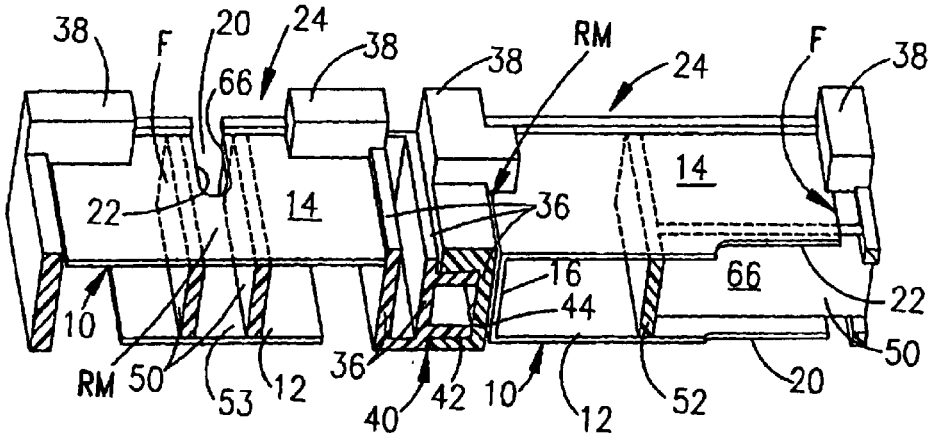
FIG. 6 is a sectional view taken along line 6—6 of FIG. 5.
Figure 7:
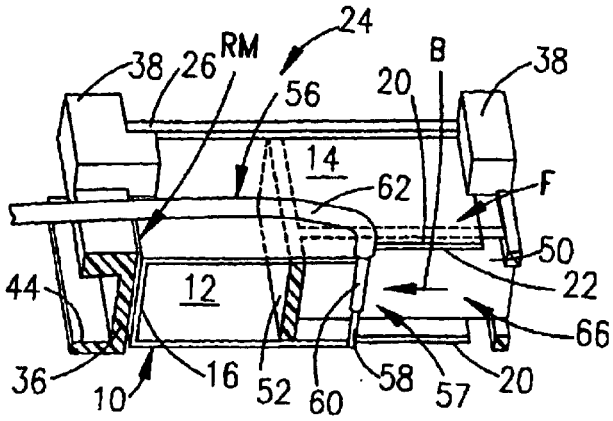
FIG. 7 is a section through the right-hand module as viewed in FIG. 6, and showing the connection of the coaxial cables to the modules; and, FIG. 8 is a diagram indicating the radiation patterns of the antenna modules when assembled together.

The openings of the modules permit the antennas to be easily slid, or otherwise introduced into their respective modules 24. FIGS. 6 and 7 best show the antenna elements 10 being supported within the module housings 26 primarily by way of a series of support walls 50, 52. Two of these support walls 50 are spaced apart from each other and extend lengthwise of the antennas from the "front" to the "rear" of the antenna element 10. These walls 50 extend alongside the antenna feed slots 20, 22 and are closed off by wall 52 to define a passage 66 between the two plates 12, 14 and which can be considered as enclosing the slots 20, 22.

This location is shown at "RM" in FIG. 6, and for purposes of explanation, the "rear" of the antenna element 10 or "RM" in FIG. 6 is considered as that portion where the short circuit plate interconnects the first and second plates together, while the "front" or "F" in FIG. 6 of the antenna is considered to be disposed at the free ends of the first and second plates. The feed slots 22 of the antenna elements are preferably aligned with this passage 53 so that they extend lengthwise of the passage 53 and so that the antenna element portions surrounding the slots 22 form in effect, top and bottom walls of the passage 66. This passage 66 facilitates the installation and termination of a feedline 56.

These support walls 50, 52 not only serve to support the radiating plates 12, but also maintain the first and second plates 12, 14 apart from each other in a particular spacing. One or more retainers shown as tabs 55 in FIGS. 2 and 4 may be provided which are spaced apart from and extend over the support walls 50, and which serve to retain the front, or free edges, of the first conductive plate in place within the module housing and prevent it from vertical movement in cooperation with the upper foldline 18a thereof. These retainers 55 may be oriented in locations where they face the open end (as shown in the left module of FIGS. 2 and 4) or where they lie along the wall adjacent the open end (as shown in the right module of FIGS. 2 and 4).

In the assembly of the antenna modules, the antenna elements may be inserted into the open end of each module housing so that antenna element slots 22 are aligned with the housing interior passages 66 and so the antenna element free ends are held in place by the retainers. In this position, a coaxial feed line 56 may be introduced into the housing passage 66. The feedline 56 first has its outer insulation layer 62 stripped to expose its shielding braid 63. The center conductor 58 of the feedline 56 is also exposed but its insulating layer 60 is left intact in a distance about equal to or slightly less than the distance D (FIG. 1) that separates the two conductive plates 14, 14. The center conductor 58 may then be terminated to the first conductive plate 12 and the shielding braid 63 may be terminated to the second conductive plate 14 as illustrated in FIG. 7. This type of structure provides a connectorless junction between the antenna and the feedline.

In another important aspect of the present invention, each of the antennas not only has an independent ground plane that is isolated from each other, but also has an "inherent" rear shield formed by the shorting plate 16 of each antenna element. This rear shield provides electrical isolation from the other antenna and any surrounding elements in the environment in which the antenna is used which assists in providing the desired performance independent of the placement of the antennas within the system. The points at which the antenna elements 10 are fed are aligned with each other and occur near the end 80 of the two slots 20, 22. (FIG. 1). The feed and ground for each antenna are thus integrated within the separate antenna elements 10, thereby eliminating the need to space them apart from each other in order to obtain a desired frequency for the antenna element.

Figure 8:
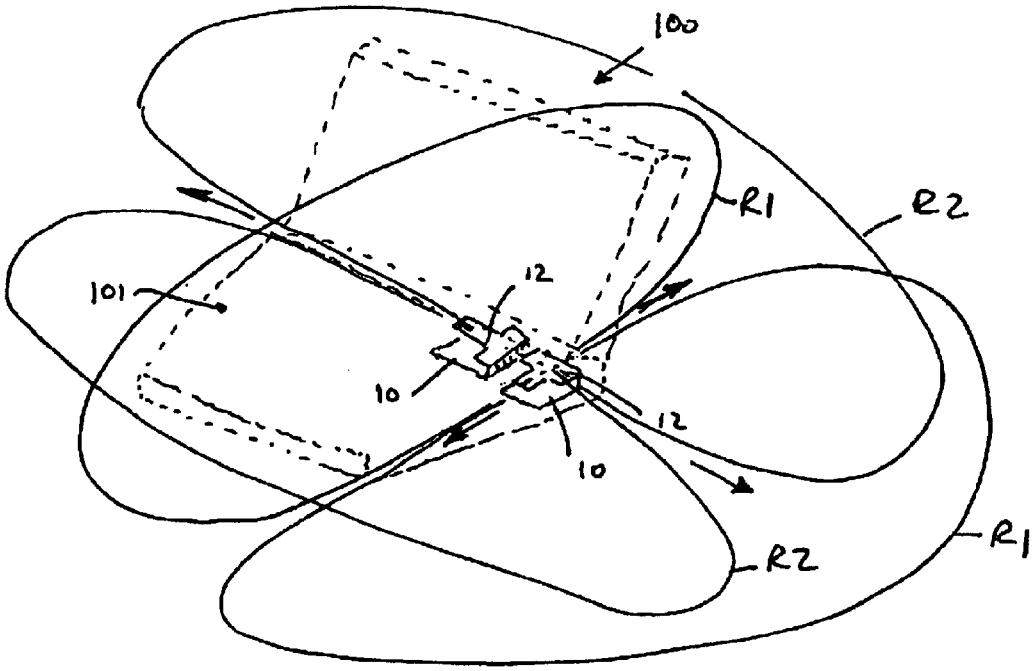

FIG. 8 illustrates the effect of the placement of the two antenna elements 10 using the housings 26 of the present invention. The two housings are joined together so that their respective slots 20 of the upper radiating plates 12 are offset from each other, and if imaginary lines were drawn lengthwise along the slots, the imaginary lines would intersect. The two radiation patterns of each antenna are shown R1 and R2 and they may be considered emanating from the entire body of each antenna element radiating plate 12. In FIG. 8, two antenna elements 10 are mounted in an offset orientation in an electronic component, such as the laptop computer 100 illustrated. The antenna elements 10 are located in the base portion 101 of the computer 100. The antenna elements 10 are positioned so that the radiating plates 12 thereof are oriented at right angles to lock other with this arrangement, each antenna element is separately polarized in different directions. As shown in FIG. 8, this results in a significant overlap of the two radiation patterns R1, R2 of the antenna elements (that extend in the direction of the arrows of FIG. 8 on opposite sides thereof) so that if the electronic component is located near a wall or in another "dead" spot, or "deep fade" that compresses the radiation pattern of one antenna element, the radiation pattern of the other antenna element will not be so detrimentally affected.

It will be understood that the invention may be embodied in other specific forms without departing from the spirit or central characteristics thereof. For example, the modules, or housings, may take different shapes than the square or rectangular structures shown. Additionally, the antenna elements may be joined together in their specific orientation by an intervening dielectric member. The present examples and embodiments, therefore, are to be considered in all respects as illustrative and not restrictive, and the invention is not to be limited to the details given herein.

What is claimed is:

1. A dual polarized antenna assembly comprising:

a pair of antenna modules (24), each antenna module (24) including a planar inverted-F antenna element (10), each antenna element (10) including a first conductive plate (12), a second conductive plate (14) spaced apart from and generally parallel to the first conductive plate (12), a third conductive plate (16) extending between and short circuiting the first and second conductive plates (12,14), and coaxial feed line (56) electrically connected to said first and second conductive plates (12,14) each antenna module (24) further including a dielectric housing (26) supporting said antenna element (10) therein, characterized in that:

each housing (26) includes a plurality of sidewalls (32, 42,36) that cooperatively define an interior cavity (29) of said housing (26), one of the sidewalls (32) including a first passage extending therethrough and communicating with the module cavity (29) through which said antenna element (10) can be inserted, another of said sidewalls including a second passage that receives a portion of said feedline (56);

means (40) disposed on the exterior of each of said antenna modules (24) for engaging said antenna modules (24) together, the engagement means (40) being disposed on sidewalls of said housing (26) that are adjacent said first passages; and, each of said antenna elements (10) includes opposing first and second ends, the antenna elements (10) being asymmetrically received within said module interior cavities (29) such that said antenna element first ends are offset from each other when said pair of antenna modules (24) are joined together, thereby orienting the polarization of each antenna element (10) in a different direction, whereby the radiating wave patterns of each of the two elements (10) at least partially overlap to improve reception of the antenna assembly.

2. The dual polarized antenna of claim 1, wherein said engagement means (40) includes a projecting tongue member (42) on one of said pair of antenna modules (24) and a recessed groove member (44) on the other of said pair of antenna modules (24), the tongue member (42) being received within the groove member (44) wherein said pair of antenna modules (24) are joined together.

3. The dual polarized antenna of claim 2, wherein said tongue and groove members (42, 44) are integrally formed with their respective antenna module housings (26).

4. The dual polarized antenna of claim 1, wherein said first conductive plates (12) of each of said antenna elements (10) act as radiators for said antenna elements (10), and each of said second conductive plates (14) act as corresponding ground planes for said antenna elements (10).

5. The dual polarized antenna of claim 4, wherein said second conductive plates (14) have a surface area greater than a corresponding surface area of said first conductive plates (12).

6. The dual polarized antenna of claim 1, wherein said third conductive plates (16) interconnect said first and second conductive plates (12, 14) along adjacent aligned edges **(18*a*, 18*b*) thereof, said third conductive plates (16) being disposed at said second ends of said antenna elements (10) in planes intersecting said first and second conductive plates (12, 14)**.

7. The dual polarized antenna of claim 1, wherein said first and second conductive plates (12, 14) of each antenna element (10) includes a feed slot (20, 22) formed therein, the feed slots (20, 22) extending lengthwise of said first and second plates (12, 14), and said feedlines (56) being connected to their respective antenna modules (24) at said feed slots (20, 22).

8. The dual polarized antenna of claim 7, wherein each housing (26) includes a plurality of support walls (50) disposed within said antenna module interior cavities (29) and extending between said first and second conductive plates (12, 14), the support walls (50) maintaining a predetermined spacing between said first and second conductive plates (12, 14).

9. The dual polarized antenna of claim 8, wherein two of said support walls (50) extend on opposite sides of said feed slots (20, 22) and define a passage that partially encloses portions of said feed slots (20, 22).

10. The dual polarized antenna of claim 1, wherein each of said third conductive plates (16) of each of said antenna modules (24) define respective rear shields of said antenna elements (10) and the rear shields are oriented transverse to each other when said two antenna modules (24) are engaged together.

11. The dual polarized antenna of claim 1, wherein each of said antenna element first conductive plates (12) is T-shaped.

12. The dual polarized antenna of claim 7, wherein each of said antenna element first conductive plates (12) is T-shaped and said slots (20, 22) extend lengthwise within said T-shape.

13. The dual polarized antenna of claim 7, wherein each of said first and second antenna slots (20, 22) begin at front edges of said first and second conductive plates (12, 14) and extend into body portions thereof, said first and second conductive plate front edges being respectively arranged transverse and parallel to said engagement means (40).

* * * * *